US008089021B2

(12) United States Patent
Kagawa

(10) Patent No.: US 8,089,021 B2
(45) Date of Patent: Jan. 3, 2012

(54) VACUUM CIRCUIT BREAKER

(75) Inventor: Kazuhiko Kagawa, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 394 days.

(21) Appl. No.: 12/394,784

(22) Filed: Feb. 27, 2009

(65) Prior Publication Data

US 2009/0218319 A1 Sep. 3, 2009

(30) Foreign Application Priority Data

Mar. 3, 2008 (JP) ..... 2008-051920

(51) Int. Cl.
*H01H 3/666* (2006.01)

(52) U.S. Cl. ..... 218/140; 218/118

(58) Field of Classification Search ..... 218/140, 218/118

See application file for complete search history.

(56) References Cited

U.S. PATENT DOCUMENTS

| | | | | |
|---|---|---|---|---|
| 4,376,235 | A | 3/1983 | Milianowicz | |
| 4,384,179 | A | 5/1983 | Milianowicz | |
| 5,530,216 | A * | 6/1996 | Benke et al. | 218/118 |
| 6,410,875 | B2 * | 6/2002 | Allard et al. | 218/118 |
| 6,444,939 | B1 * | 9/2002 | Crookston et al. | 218/140 |
| 7,529,009 | B2 * | 5/2009 | Moon et al. | 359/198.1 |
| 7,852,617 | B2 * | 12/2010 | Lee | 361/676 |

FOREIGN PATENT DOCUMENTS

| | | |
|---|---|---|
| JP | 57-152627 | 9/1982 |
| JP | 06-208821 A | 7/1994 |
| JP | 08-287795 A | 11/1996 |

OTHER PUBLICATIONS

Office Action (Notification of Reasons for Refusal) dated Jul. 19, 2011, issued in the corresponding Japanese Patent Application No. 2008-051920, and an English Translation thereof.

* cited by examiner

*Primary Examiner* — Truc Nguyen

(74) *Attorney, Agent, or Firm* — Buchanan Ingersoll & Rooney PC

(57) ABSTRACT

An object is to provide a vacuum circuit breaker that has a lower electrical and thermal resistance at contacting portions between a movable electrode-rod and a movable-electrode-side connection-terminal so that a continuous current-carrying capacity is made larger without reinforcement and/or enhancement of an operating mechanism. The vacuum circuit breaker herein provided includes a vacuum interrupter held inside an insulation frame; a fixed electrode-rod mounted on one side of the vacuum interrupter; a movable electrode-rod mounted on the other side of the vacuum interrupter; a flexible conductor for electrically connecting the movable electrode-rod with a main-circuit conductor; and a movable-electrode-side connection-terminal fastened on the outer circumference of said movable electrode-rod; wherein the flexible conductor is gripped by a first face and a second face of the movable-electrode-side connection-terminal.

10 Claims, 6 Drawing Sheets

VACUUM CIRCUIT BREAKER

BACKGROUND OF THE INVENTION

1. Field of the Invention

The present invention relates to a vacuum circuit breaker that includes an insulation frame accommodating therein, for example, a vacuum interrupter, and an operating mechanism that operates a vacuum circuit breaker from outside thereof.

2. Description of the Related Art

This kind of vacuum circuit breaker is provided with a movable-electrode-side split-terminal on the movable electrode-shaft so as to electrically connect the movable electrode-shaft of the vacuum interrupter with a flexible conductor of the vacuum circuit breaker. By touching the movable-electrode-side split-terminal to one surface portion at one end of the flexible conductor and by tightly fastening them together using bolts, the movable electrode-shaft and the flexible conductor are electrically connected to each other (for example, refer to Japanese Patent Application Publication No. H06-208821, Paragraph 0004, FIG. 1).

Meanwhile, a flexible conductor is clamped at both top and bottom surface sides by a pair of support metal-plates, and the flexible conductor and the support metal-plates are securely tightened together using a nut, so that the flexible conductor is fixed onto a movable rod together with the support metal-plates. (For example, refer to Japanese Patent Application Publication No. H08-287795, Paragraphs 0013, 0019, FIG. 2.)

Problems to be Solved by the Invention

In such a conventional vacuum circuit breaker disclosed in Patent Application Publication No. H06-208821 (Paragraph 0004, FIG. 1), a connection structure of a movable electrode-rod, i.e., a movable electrode-shaft, with a flexible conductor is made by means of a movable-electrode-side connection-terminal (connection-terminal on the side of the movable electrode), i.e., a movable-electrode-side split-terminal. Since the connection between the movable-electrode-side connection-terminal and the flexible conductor is established only by making the connection-terminal contact with one surface portion at the flexible conductor followed by fastening them using bolts, a contact area is small, leading to a state whereby the electrical resistance and thermal resistance at connecting portions are high.

In addition, in such a conventional vacuum circuit breaker disclosed in Japanese Patent Application Publication No. H08-287795 (Paragraphs 0013, 0019, FIG. 2), a contact area between a flexible conductor and movable-electrode-side connection-terminals is made larger by using a pair of the movable-electrode-side connection-terminals and by clamping the flexible conductor at its top and bottom surface sides by the movable-electrode-side connection-terminals, i.e., support metal-plates, mounted by insertion onto a movable electrode-rod, i.e., a movable rod, followed by securely tightening the flexible conductor with the movable-electrode-side connection-terminals using a nut. However, since the movable-electrode-side connection-terminals are mounted only by insertion onto the movable electrode-rod, the contact area between the movable-electrode-side connection-terminals and the movable electrode-rod is small, leading to a state whereby the electrical resistance and thermal resistance are high at the connecting portions.

Since a continuous current-carrying capacity of a vacuum circuit breaker is defined usually by a maximum value of temperature rise at individual portions, the higher the electrical resistance is the larger the heat generation due to the energization, and the more restricted the current-carrying capacity. Moreover, heat build-up of the vacuum circuit breaker is in general due to generation at contacting portions each. Much of the generated heat is transferred by way of electric conductors, ultimately to a distribution-board or switchgear through main-circuit conductors that connect the vacuum circuit breaker with the switchgear, and is dissipated there. Since the cooling is performed as described above, it is desirable that the electric conductors to be used be lower in thermal resistance as well as in electrical resistance. However, when contact areas are made to be increased between a movable-electrode-side connection-terminal and a flexible conductor, and the movable-electrode-side connection-terminal and a movable electrode-rod for reducing the electrical resistance and thermal resistance, there arises a problem in that the movable-electrode-side connection-terminal is made larger, resulting in an increase of the mass and a lowered operation speed of the vacuum circuit breaker.

The present invention has been directed at solving those problems described above, and an object of the invention is to obtain a vacuum circuit breaker that has a large continuous current-carrying capacity in which, by increasing the contact areas between the movable-electrode-side connection-terminal and a flexible conductor, and the movable-electrode-side connection-terminal and a movable electrode-rod with each other without making a movable-electrode-side connection-terminal larger, the electrical resistance and thermal resistance are reduced at connecting portions of the movable-electrode-side connection-terminal and the flexible conductor, and the movable-electrode-side connection-terminal and the movable electrode-rod, so that heat generation due to the energization is reduced, and thermal conductivity is enhanced.

SUMMARY OF THE INVENTION

Means for Solving the Problems

In one aspect, a vacuum circuit breaker according to the present invention comprises: a vacuum interrupter held inside an insulation frame; a fixed electrode-rod mounted on one side of the vacuum interrupter; a movable electrode-rod mounted on the other side of the vacuum interrupter; a flexible conductor for electrically connecting the movable electrode-rod with a main-circuit conductor; and a movable-electrode-side connection-terminal fastened on the outer circumference of the movable electrode-rod; wherein the flexible conductor is gripped by a first face and a second face of the movable-electrode-side connection-terminal.

Effects of the Invention

According to the present invention, a vacuum circuit breaker that has a large continuous current-carrying capacity can be obtained without making a movable-electrode-side connection-terminal larger, that comprises: a vacuum interrupter held inside an insulation frame; a fixed electrode-rod mounted on one side of the vacuum interrupter; a movable electrode-rod mounted on the other side of the vacuum interrupter; a flexible conductor for electrically connecting the movable electrode-rod with a main-circuit conductor; and a movable-electrode-side connection-terminal fastened on the outer circumference of the movable electrode-rod; wherein the flexible conductor is gripped by a first face and a second face of the movable-electrode-side connection-terminal.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Hereunder, preferred embodiments according to the present invention will be described in detail with reference to the accompanying drawings.

Embodiment 1

Figure 1:
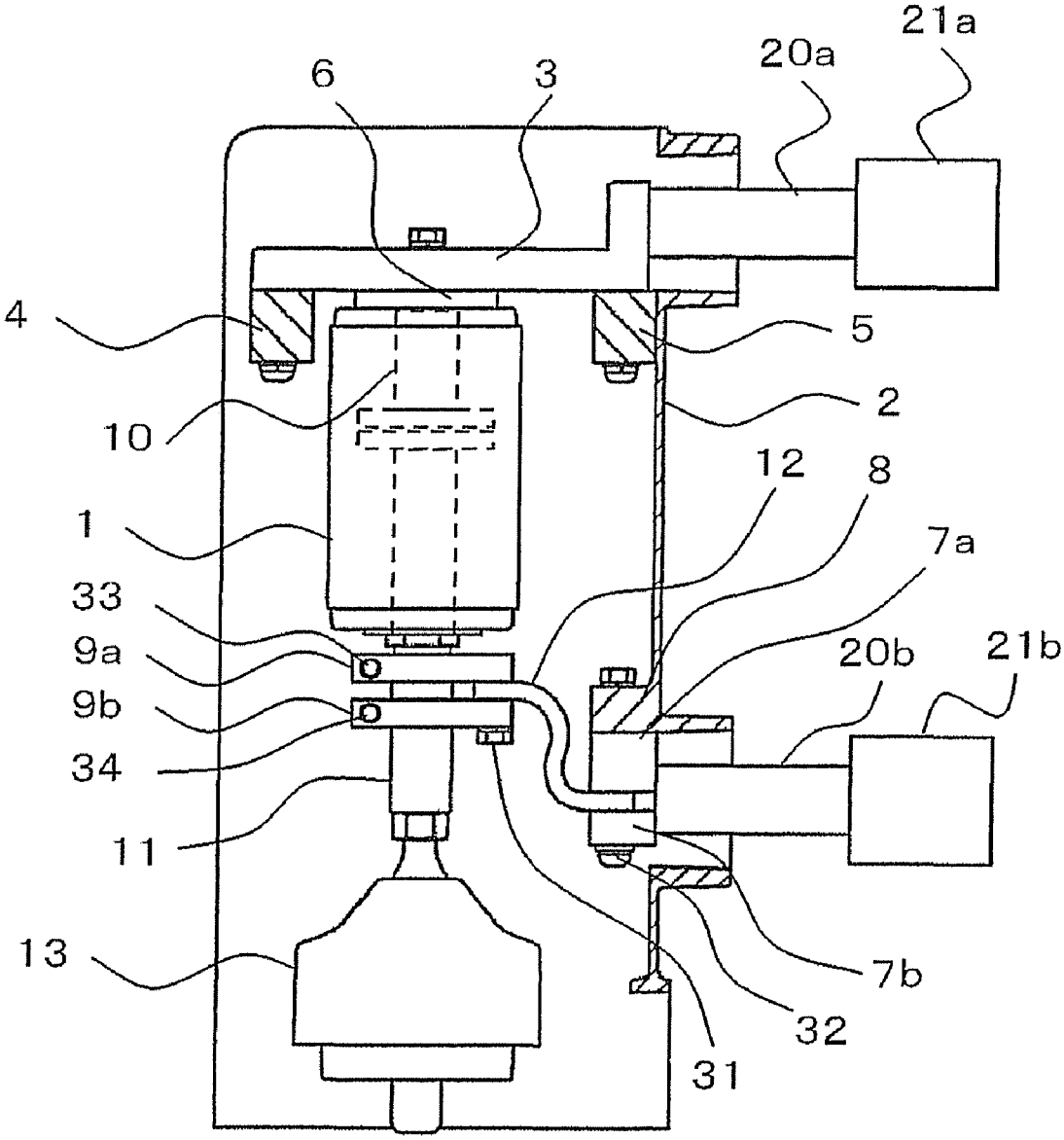
FIG. 1 is a cross-sectional side diagram illustrating a vacuum circuit breaker according to Embodiment 1.
Figure 2:
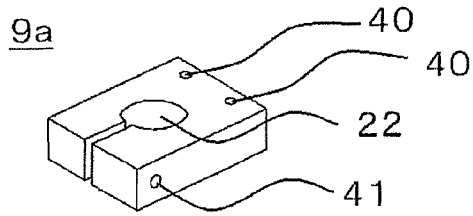
FIG. 2 is a perspective view showing a top movable-electrode-side connection-terminal of the vacuum circuit breaker in Embodiment 1.
Figure 3:
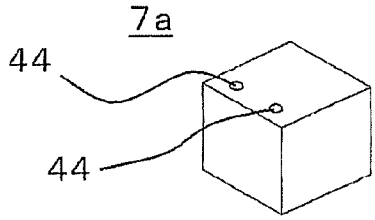
FIG. 3 is a perspective view showing a top movable-electrode-side conductor-terminal of the vacuum circuit breaker in Embodiment 1.
Figure 4:
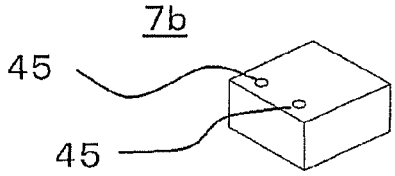
FIG. 4 is a perspective view showing a bottom movable-electrode-side conductor-terminal of the vacuum circuit breaker in Embodiment 1.
Figure 5:
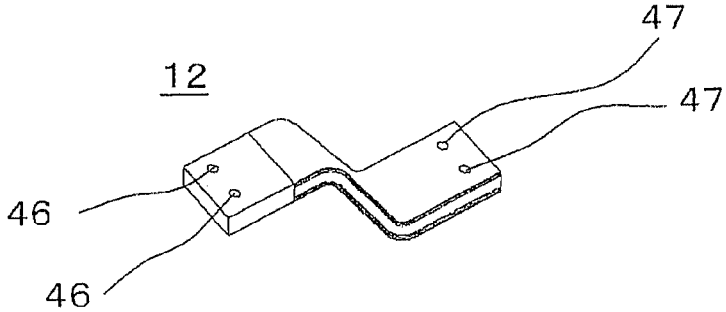
FIG. 5 is a perspective view showing a flexible conductor of the vacuum circuit breaker in Embodiment 1.

FIG. 1 is a cross-sectional side diagram illustrating a vacuum circuit breaker according to Embodiment 1 for carrying out the present invention; FIG. 2, a perspective view showing a top movable-electrode-side connection-terminal (top-side connection-terminal on the side of a movable electrode) of the vacuum circuit breaker in FIG. 1; FIG. 3, a perspective view showing a top movable-electrode-side conductor-terminal (top-side conductor-terminal on the side of the movable electrode) of the vacuum circuit breaker in FIG. 1; FIG. 4, a perspective view showing a bottom movable-electrode-side conductor-terminal (bottom-side conductor-terminal on the side of the movable electrode) of the vacuum circuit breaker in FIG. 1; and FIG. 5, a perspective view showing a flexible conductor in FIG. 1. Note that, the same reference numerals and symbols designate the same items as or the items corresponding to those shown in the figures.

In FIG. 1, the vacuum circuit breaker installs inside a vacuum interrupter 1 that is supported by an insulation frame 2. The vacuum interrupter 1 has a pair of electrodes that are capable of making or breaking contact with each other, and are accommodated in a vacuum vessel of the valve, one of the electrodes being securely fastened onto a fixed electrode-rod 10 that is fixed onto the vacuum interrupter 1, and the other one of the electrodes securely fastened onto a movable electrode-rod 11 that is driven by an operating mechanism not shown. The fixed electrode-rod 10 is fastened by way of a fixed electrode-plate 6 onto a fixed-electrode-side conductor-terminal 3 by a bolt. The fixed-electrode-side conductor-terminal 3 bridges to interconnect a front mounting portion 4 and a rear mounting portion 5 that are integrally formed with the insulation frame 2, and is fastened by bolts, so that the vacuum interrupter 1 is fixed onto the insulation frame 2. Moreover, the fixed-electrode-side conductor-terminal 3 is electrically connected by way of a first main-circuit conductor 20*a* to the outside of the vacuum circuit breaker, for example, to a connector 21*a* provided to connect with a main circuit of a distribution-board or switchgear on the busbar side thereof. According to these arrangements, the first main-circuit conductor 20*a* and the fixed electrode-rod 10 are electrically connected to each other.

On the other hand, the movable electrode-rod 11 is coupled by way of an insulation rod 13 to the operating mechanism described above. In addition, the movable-electrode-side connection-terminal 9*a* shown in FIG. 2 and a movable-electrode-side connection-terminal 9*b* that has the same shape with the movable-electrode-side connection-terminal 9*a* are provided on the movable electrode-rod 11 between the vacuum interrupter 1 and the insulation rod 13. The movable-electrode-side connection-terminal 9*a* is fastened onto the outer circumference of the movable electrode-rod 11 by passing the movable electrode-rod 11 through a hole 22 followed by securely tightening a bolt 33 that has been inserted into a bolt hole 41 of the movable-electrode-side connection-terminal 9*a* from the lateral side thereof. The movable-electrode-side connection-terminal 9*b* is also fastened in the similar manner.

Using the bottom face of the movable-electrode-side connection-terminal 9*a* and the top face of the movable-electrode-side connection-terminal 9*b* as the contacting faces, one end of a flexible conductor 12 is clamped therebetween that is made of band-like thin plates overlapping and spaced with each other. Two bolt holes 46 are provided for the flexible conductor 12 as a pair, and correspondingly, a pair of bolt holes 40 is also provided for each of the movable-electrode-side connection-terminals 9*a* and 9*b*. The flexible conductor 12 is fastened between the movable-electrode-side connection-terminals 9*a* and 9*b* in such a manner that the flexible conductor 12 is clamped between the movable-electrode-side connection-terminals 9*a* and 9*b* so that the pairs of bolt holes provided for each of them are aligned to overlap one another, and a pair of bolts 31 are passed through those overlapped bolt holes and securely tightened.

Using the bottom face of the movable-electrode-side conductor-terminal 7*a* shown in FIG. 3 and the top face of the movable-electrode-side conductor-terminal 7*b* shown in FIG. 4 as the contacting faces, the other end of the flexible conductor 12 is similarly clamped by the movable-electrode-side conductor-terminal 7*a* and the movable-electrode-side conductor-terminal 7*b* in such a manner that pairs of bolt holes 45, 47 and 44 provided for each of them are overlapped one another, and a pair of bolts 32 is passed through those and securely tightened with each other; thereby, the flexible conductor 12 is fastened between the movable-electrode-side conductor-terminals 7*a* and 7*b* so that the flexible conductor 12 and the movable-electrode-side conductor-terminals 7*a* and 7*b* are electrically connect to each other. In addition, these movable-electrode-side conductor-terminals 7*a* and 7*b* are fastened securely onto a second main-circuit conductor 20*b*, and are electrically connected to a connector 21*b*. The movable-electrode-side conductor-terminal 7*a* is fastened by bolts onto a rear mounting portion 8 that is integrally formed with the insulation frame 2, and is fixed onto the insulation frame 2. Moreover, the connector 21*b* is connected to the outside of the vacuum circuit breaker, for example, to a main circuit of the switchgear on the load side thereof.

Next, in the vacuum circuit breaker that is configured as described above, the operations during a continuous energization will be explained. A current is supplied from the connector 21*a* connected to the main circuit of the switchgear on the busbar side, passing through the first main-circuit conductor 20*a*, the fixed-electrode-side conductor-terminal 3, the fixed electrode-plate 6, the fixed electrode-rod 10, the movable electrode-rod 11, the movable-electrode-side connection-terminals 9*a* and 9*b*, the flexible conductor 12, the movable-electrode-side conductor-terminals 7*a* and 7*b*, and the second main-circuit conductor 20*b*, and then is supplied through the connector 21*b* into the main circuit of the switchgear on the load side thereof. At this time, the movable electrode-rod 11 and the movable-electrode-side connection-terminal 9*a* are energized therebetween through the inner wall of the hole 22 of the movable-electrode-side connection-terminal 9*a* as the contacting face. The movable electrode-rod 11 and the movable-electrode-side connection-terminal 9*b* are also energized therebetween in a similar manner. In addition, the movable-electrode-side connection-terminals 9*a* and 9*b*, and the flexible conductor 12 contact with each other through the bottom face of the movable-electrode-side connection-terminal 9*a* and the top face of one end of the flexible conductor 12, and also through the top face of the movable-electrode-side connection-terminal 9*b* and the bottom face of the same one end of the flexible conductor 12, so that the current flows by way of these two sets of contacting faces. In addition, the flexible conductor 12 and the movable-electrode-side conductor-terminals 7*a* and 7*b* contact with each other through the bottom face of the movable-electrode-side conductor-terminal 7*a* and the top face of the other end of the flexible conductor 12, and also through the top face of the movable-electrode-side conductor-terminal 7*b* and the bottom face of the same other end of the flexible conductor 12, so that the current flows by way of these two sets of contacting faces.

According to Embodiment 1, the movable-electrode-side connection-terminals 9*a* and 9*b* are provided on the movable electrode-rod 11 so that the bottom face of the movable-electrode-side connection-terminal 9*a* and the top face of one end of the flexible conductor 12 contact with each other, and in addition, the top face of the movable-electrode-side connection-terminal 9*b* and the bottom face of the same one end of the flexible conductor 12 contact with each other. Because the current flows by way of these two sets of contacting faces, the contact area is increased so that the electrical resistance and thermal resistance at the connecting portions of the flexible conductor 12 and the movable-electrode-side connection-terminals 9*a* and 9*b* can be reduced by half. Moreover, the movable electrode-rod 11 and the movable-electrode-side connection-terminals 9*a* and 9*b* contact with each other through the inner wall of each of the holes 22. Furthermore, because the movable-electrode-side connection-terminals 9*a* and 9*b* are fastened onto the movable electrode-rod 11 by the bolts 33 and 34, a high contact pressure is applied on the contacting face of each of the holes 22; as a result, an effective contact area also increases so that the electrical resistance and thermal resistance can be reduced by half. According to these arrangements, because heat generation due to the energization is reduced at the connecting portions, and the generated heat is more easily to dissipate to the surroundings, it is possible to obtain a vacuum circuit breaker that has a large continuous current-carrying capacity without making a movable-electrode-side connection-terminal larger.

Embodiment 2

Figure 6:
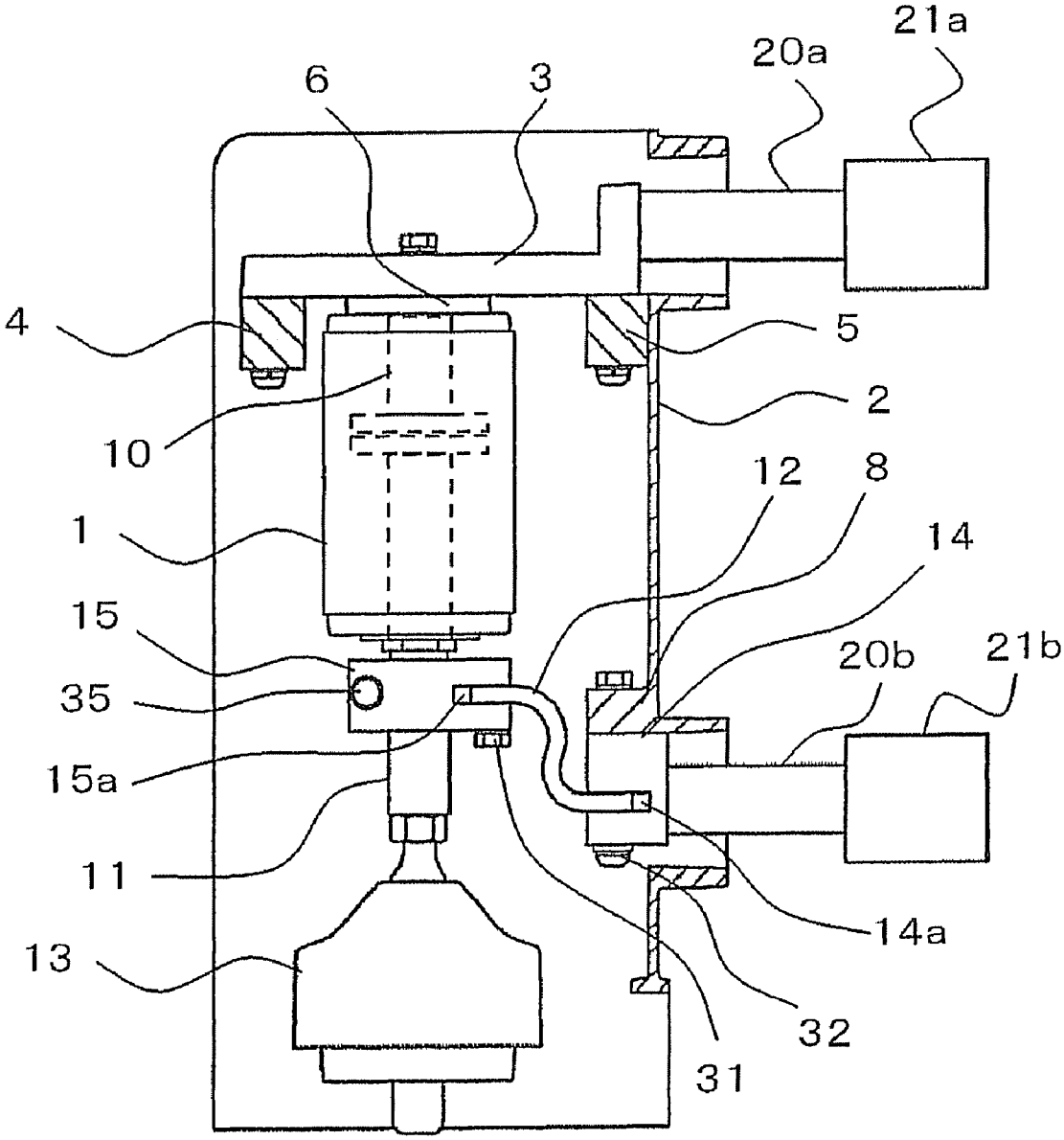
FIG. 6 is a cross-sectional side diagram illustrating a vacuum circuit breaker according to Embodiment 2.
Figure 7:
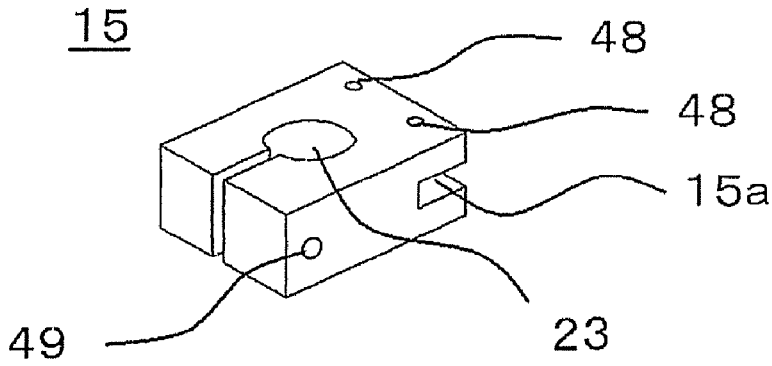
FIG. 7 is a perspective view showing a movable-electrode-side connection-terminal of the vacuum circuit breaker in Embodiment 2.
Figure 8:
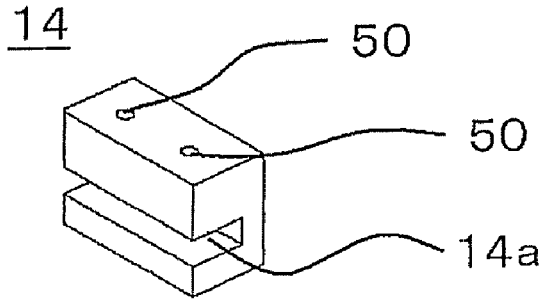
FIG. 8 is a perspective view showing a movable-electrode-side conductor-terminal of the vacuum circuit breaker in Embodiment 2.

FIG. 6 is a cross-sectional side diagram illustrating a vacuum circuit breaker according to Embodiment 2 for carrying out the present invention; FIG. 7, a perspective view showing a movable-electrode-side connection-terminal of the vacuum circuit breaker in FIG. 6; and FIG. 8, a perspective view showing a movable-electrode-side conductor-terminal of the vacuum circuit breaker in FIG. 6. Note that, the same reference numerals and symbols designate the same items as or the items corresponding to those shown in the figures; thus, their explanation is omitted. In Embodiment 1, the movable-electrode-side connection-terminals 9*a* and 9*b* are provided in such a manner that one end of the flexible conductor 12 is clamped by the movable-electrode-side connection-terminals 9*a* and 9*b* so that the bottom face of the movable-electrode-side connection-terminal 9*a* and the top face of the same one end of the flexible conductor 12 contact with each other, and in addition, the top face of the movable-electrode-side connection-terminal 9*b* and the bottom face of the same one end of the flexible conductor 12 contact with each other; however, in Embodiment 2, there used in place of the connection-terminals is the movable-electrode-side connection-terminal 15 shown in FIG. 7 that has a slit 15*a* approximately in the middle of one lateral side thereof. In addition, in Embodiment 1, the movable-electrode-side conductor-terminals 7*a* and 7*b* are provided so that the bottom face of the movable-electrode-side conductor-terminal 7*a* and the top face of the other end of the flexible conductor 12 contact with each other, and in addition, the top face of the movable-electrode-side conductor-terminal 7*b* and the bottom face of the same other end of the flexible conductor 12 contact with each other; however, in Embodiment 2, there used in place of the conductor-terminals is the movable-electrode-side conductor-terminal 14 shown in FIG. 8 that has a slit 14*a* approximately in the middle of one lateral side thereof. In this case, fastened onto the outer circumference of the movable electrode-rod 11 is the movable-electrode-side connection-terminal 15 having a hole 23 through which the movable electrode-rod 11 passes, and being tightened by a bolt 35 from lateral side thereof. In addition, the movable-electrode-side connection-terminal 15 and the flexible conductor 12 are fastened by inserting one end of the flexible conductor 12 into the slit 15*a* of the movable-electrode-side connection-terminal 15, followed by tightening together the movable-electrode-side connection-terminal 15 and the flexible conductor 12 using a pair of bolts 31 having been passed through pairs of bolt holes 48 and 46 from the under side. In addition, the movable-electrode-side conductor-terminal 14 and the flexible conductor 12 are fastened by inserting the other end of the flexible conductor 12 into the slit 14*a* of the movable-electrode-side conductor-terminal 14, followed by tightening together the movable-electrode-side conductor-terminal 14 and the flexible conductor 12 using a pair of bolts 32 having been passed through pairs of bolt holes 50 and 47 from the under side. Note that, other items and components take the same as in Embodiment 1.

Next, in the vacuum circuit breaker that is configured in Embodiment 2 as described above, the operations during a continuous energization will be explained. The movable electrode-rod 11 and the movable-electrode-side connection-terminal 15 are energized therebetween by way of the inner wall of the hole 23 and the contacting face of the movable electrode-rod 11. In addition, the movable-electrode-side connection-terminal 15 and the flexible conductor 12 contact with each other through the top inner face of the slit 15*a* provided in the movable-electrode-side connection-terminal 15 and the top face of one end of the flexible conductor 12, and also, the bottom inner face of the slit 15*a* and the bottom face of the same one end of the flexible conductor 12 contact with each other, so that the current flows by way of these two sets of contacting faces. Moreover, the flexible conductor 12 and the movable-electrode-side conductor-terminal 14 contact with each other through the top inner face of the slit 14*a* provided in the movable-electrode-side conductor-terminal 14 and the top face of the other end of the flexible conductor 12, and in addition, the bottom inner face of the slit 14*a* and the bottom face of the same other end of the flexible conductor 12 contact with each other, so that the current flows by way of these two sets of contacting faces. Other items and components take the same as in Embodiment 1; thus, their explanation is omitted.

According to Embodiment 2, the movable-electrode-side connection-terminal 15 having the slit 15*a* is provided on the movable electrode-rod 11 so that the top inner face of the slit 15*a* provided in the movable-electrode-side connection-terminal 15 and the top face of one end of the flexible conductor 12 contact with each other, and also, the bottom inner face of the slit 15*a* provided in the movable-electrode-side connection-terminal 15 and the bottom face of the same one end of the flexible conductor 12 contact with each other. Because the current flows by way of these two sets of contacting faces, the electrical resistance and thermal resistance at the connecting portions of the flexible conductor 12 and the movable-electrode-side connection-terminal 15 can be reduced by half. In addition, the movable electrode-rod 11 and the movable-electrode-side connection-terminal 15 contact with each other through the inner wall of the hole 23. In addition, because the movable-electrode-side connection-terminal 15 is fastened onto the movable electrode-rod 11 by the bolt 35, a high contact pressure is applied on the contacting face of the hole 23 so that the electrical resistance and thermal resistance can be reduced by half. According to these arrangements, heat generation due to the energization is reduced at the connecting portions, and the generated heat is more easily to dissipate to the surroundings; it is, therefore, possible to obtain a vacuum circuit breaker that has a large continuous current-carrying capacity without making a movable-electrode-side connection-terminal larger. Moreover, because the movable-electrode-side connection-terminal 15 is made of a single component, the number of components is reduced, so that assembling is made easy. Furthermore, because the connection between the movable-electrode-side connection-terminal 15 and the flexible conductor 12 is realized by the method in which the flexible conductor 12 is inserted into the slit 15*a* provided for the movable-electrode-side connection-terminal 15, and is fastened by the pair of bolts 31, upward/downward alignment of the flexible conductor 12 is unnecessary, so that the assembling is made easy.

Note that, although here the connection between the movable-electrode-side connection-terminal 15 and the flexible conductor 12 is established by providing the slit 15*a* for the movable-electrode-side connection-terminal 15, a catching or engagement hole may be provided in place of the slit into which one end of the flexible conductor 12 is inserted. In this case, because the movable-electrode-side connection-terminal 15 and the flexible conductor 12 also contact with each other at their lateral sides to provide contacting faces in addition to that of the top face of the flexible conductor 12 and that of the bottom face thereof, the electrical resistance and thermal resistance at connecting portions can be further reduced, and heat generation due to the energization can be furthermore reduced at the connecting portions.

Embodiment 3

Figure 9:
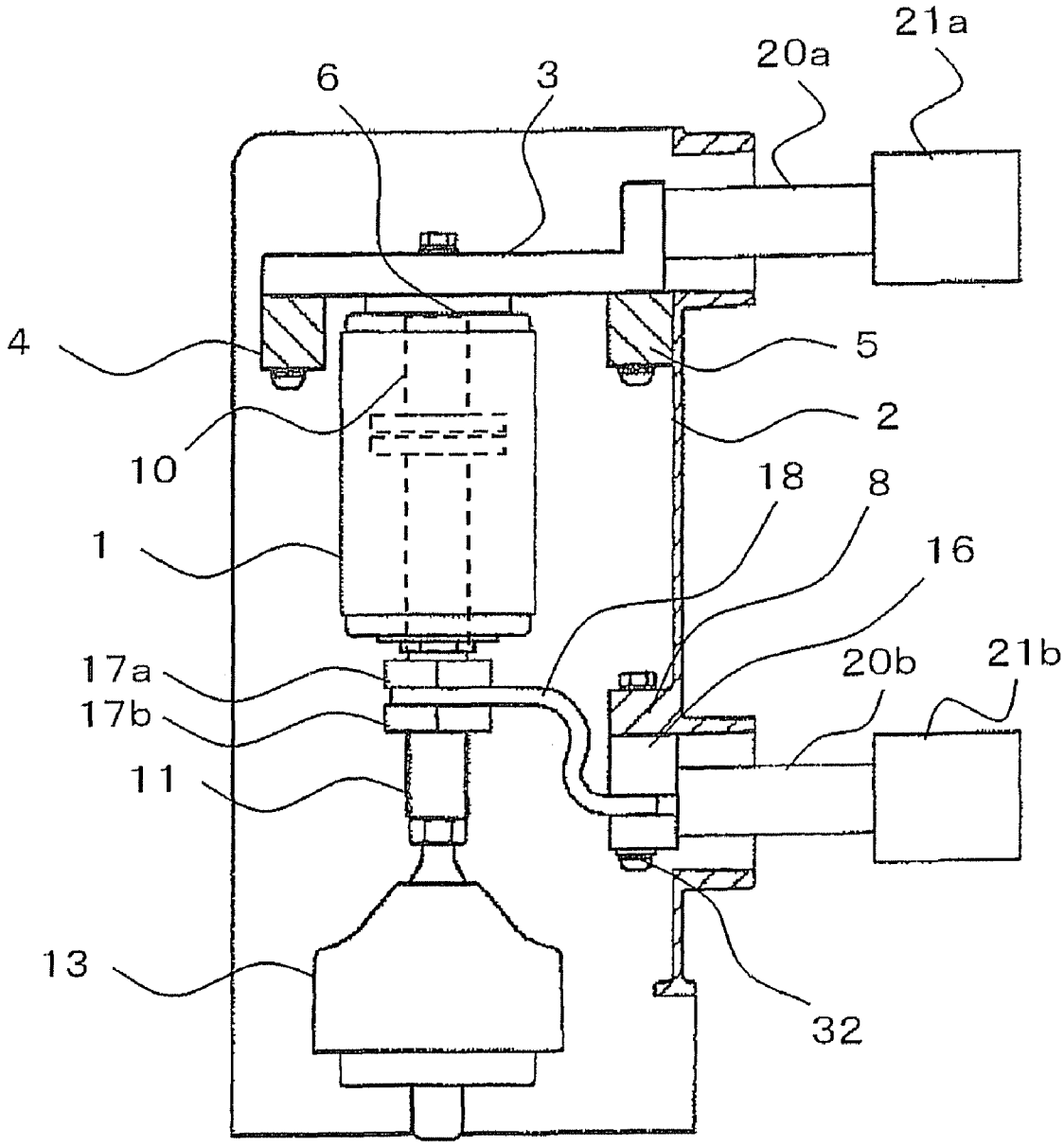
FIG. 9 is a cross-sectional side diagram illustrating a vacuum circuit breaker according to Embodiment 3.
Figure 10:
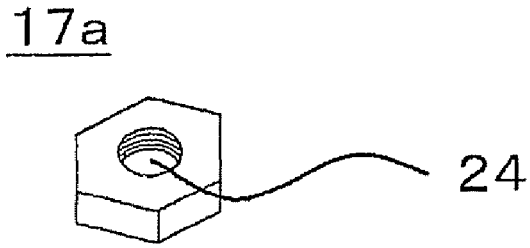
FIG. 10 is a perspective view showing a movable-electrode-side connection-terminal of the vacuum circuit breaker in Embodiment 3.
Figure 11:
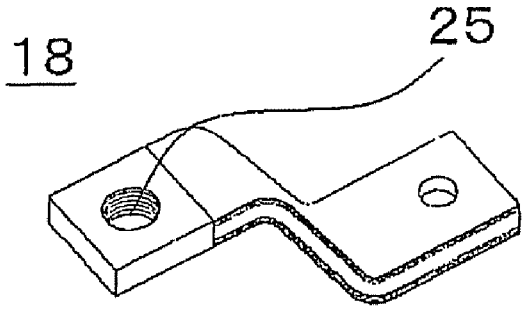
FIG. 11 is a perspective view showing a flexible conductor of the vacuum circuit breaker in Embodiment 3.

FIG. 9 is a cross-sectional side diagram illustrating a vacuum circuit breaker according to Embodiment 3 for carrying out the present invention; FIG. 10 is a perspective view showing one of movable-electrode-side connection-terminals of the vacuum circuit breaker in FIG. 9; and FIG. 11, a perspective view showing a flexible conductor of the vacuum circuit breaker in FIG. 9. Note that, the same reference numerals and symbols designate the same items as or the items corresponding to those shown in the figures; thus, their explanation is omitted. In Embodiment 1, the movable-electrode-side connection-terminals 9*a* and 9*b* are provided and fastened by the pair of bolts 31 so that the bottom face of the movable-electrode-side connection-terminal 9*a* and the top face of one end of the flexible conductor 12 contact with each other, and in addition, the top face of the movable-electrode-side connection-terminal 9*b* and the bottom face of the same one end of the flexible conductor 12 contact with each other; however, in place of using those connection-terminals, in Embodiment 3, a male screw-thread is made on the external circumference of the movable electrode-rod 11, a female screw-thread 24 that engages with the male screw-thread is made in the movable-electrode-side connection-terminal 17*a* as shown in FIG. 10 and also in a movable-electrode-side connection-terminal 17*b* (both shown in FIG. 9), and in addition, a female screw-thread 25 that engages with the male screw-thread of the movable electrode-rod 11 is made in one end of the flexible conductor 18 as shown in FIG. 11. Note that, the flexible conductor 18, which is made of a plurality of band-like thin plates overlapping and spaced with each other, cannot meet, as it is, the formation of the female screw-thread 25 without further augmenting a factor; however, by tightly jointing end-portions of the thin plates each by welding or the like, their end-portions are integrally combined, so that it is possible to make the female screw-thread 25 in the flexible conductor 18. In this case, the movable-electrode-side connection-terminal 17*a* is fastened onto the movable electrode-rod 11 in the same manner as using a nut; next, the flexible conductor 18 is fastened onto the movable electrode-rod 11; and finally, the movable-electrode-side connection-terminal 17*b* is also fastened onto the movable electrode-rod 11 in the same manner as using a nut. Other items and components take the same as in Embodiment 1.

Next, in the vacuum circuit breaker that is configured in Embodiment 3 as described above, the operations during a continuous energization will be explained. The movable-electrode-side connection-terminals 17*a* and 17*b*, and the flexible conductor 18 contact with each other through the bottom face of the movable-electrode-side connection-terminal 17*a* and the top face of one end of the flexible conductor 18, and in addition, the top face of the movable-electrode-side connection-terminal 17*b* and the bottom face of the same one end of the flexible conductor 18 contact with each other, so that the current flows by way of these two sets of contacting faces. The movable electrode-rod 11 and the movable-electrode-side connection-terminals 17*a* and 17*b* are energized therebetween by way of the thread face of each of the female screw-threads 24, and the thread face of the male screw-thread of the movable electrode-rod 11. In addition, the movable electrode-rod 11 and the flexible conductor 18 are energized therebetween by way of the thread face of the female screw-thread 25 and the thread face of the male screw-thread of the movable electrode-rod 11. Other items and components take the same as in Embodiment 1; thus, their explanation is omitted.

According to Embodiment 3, a male screw-thread is made on the external circumference of the movable electrode-rod 11; the female screw-thread 24 that engages with the male screw-thread is made in each of the movable-electrode-side connection-terminals 17*a* and 17*b*; and in addition, the female screw-thread 25 that engages with the male screw-thread of the movable electrode-rod 11 is made in one end of the flexible conductor 18. Accordingly, the movable-electrode-side connection-terminals 17*a* and 17*b*, and the flexible conductor 18 contact with each other through the bottom face of the movable-electrode-side connection-terminal 17*a* and the top face of the same one end of the flexible conductor 18, and in addition, the top face of the movable-electrode-side connection-terminal 17*b* and the bottom face of the same one end of the flexible conductor 18 contact with each other, so that the current flows by way of these two sets of contacting faces.

According to these arrangements, because the flexible conductor 18 is directly fastened by the movable-electrode-side connection-terminals 17*a* and 17*b*, in addition to the effects similar to those in Embodiment 1, the bolt holes through which the bolts pass become unnecessary for the movable-electrode-side connection-terminals 17*a* and 17*b*, so that the space provided for those drilled bolt holes becomes unnecessary; therefore, the movable-electrode-side connection-terminals 17*a* and 17*b* can be made smaller in size and thus lighter in weight, resulting in an increased open/close operation speed of the vacuum circuit breaker, so that a vacuum circuit breaker with even higher performance can be obtained. In addition, the movable electrode-rod 11 and the movable-electrode-side connection-terminals 17*a* and 17*b* are energized therebetween by way of a thread face of each of the female screw-threads 24, and a thread face of the male screw-thread of the movable electrode-rod 11. Moreover, the movable electrode-rod 11 and the flexible conductor 18 are energized therebetween by way of a thread face of the female screw-thread 25 and a thread face of the male screw-thread of the movable electrode-rod 11. According to these arrangements, because respective thread faces contact with one another by way of the screw thread and root thereof, a contact area is made larger, so that the electrical resistance and thermal resistance at contacting portions can be further lowered. Consequently, because heat generation due to the energization is reduced at the connecting portions, and the generated heat is more easily to dissipate to the surroundings, it is possible to obtain a vacuum circuit breaker that has a large continuous current-carrying capacity without making a movable-electrode-side connection-terminal larger.

Although in Embodiment 1 through Embodiment 3 the contacting faces are provided at one end of the flexible conductor to contact with such a movable-electrode-side connection-terminal, one end of the flexible conductor is not necessarily provided; the contacting faces may be provided approximately in the middle of the flexible conductor to contact with the movable-electrode-side connection-terminal. In this case, for example, the flexible conductor is figure-U shaped and gripped in the middle thereof by the movable-electrode-side connection-terminal, and in addition, a bifurcated arm that is extended toward a movable electrode-rod is provided for a movable-electrode-side conductor-terminal, so that the arm and both ends of the flexible conductor are fastened together by a bolt so as to be electrically connected to each other. To sum up, it is possible to electrically connect the movable-electrode-side connection-terminal and the movable-electrode-side conductor-terminal to each other by gripping the flexible conductor. in the middle thereof using the movable-electrode-side connection-terminal, and by gripping both the ends of the flexible conductor using the movable-electrode-side conductor-terminal.

While the present invention has been shown and described in detail, the foregoing description is in all aspects illustrative and not restrictive. It is therefore understood that numerous modifications and variations can be realized without departing from the scope of the invention.

What is claimed is:

1. A vacuum circuit breaker, comprising:

a vacuum interrupter held inside an insulation frame;

a fixed electrode-rod mounted on one side of said vacuum interrupter;

a movable electrode-rod mounted on the other side of said vacuum interrupter;

a flexible conductor for electrically connecting said movable electrode-rod with a main-circuit conductor; and a movable-electrode-side connection-terminal fastened on the outer circumference of said movable electrode-rod, the movable-electrode-side connection-terminal including a hole that receives the movable electrode-rod, the hole extending from a top-most surface to a bottom-most surface of the movable-electrode-side connection-terminal; wherein said flexible conductor is gripped by a first face and a second face of said movable-electrode-side connection-terminal.

2. The vacuum circuit breaker as set forth in claim 1, wherein the movable-electrode-side connection-terminal comprises a first movable-electrode-side connection-terminal and a second movable-electrode-side connection-terminal, the first movable-electrode-side connection-terminal has the first face, and the second movable-electrode-side connection-terminal has the second face that faces the vacuum interrupter.

3. A vacuum circuit breaker, comprising:

a vacuum interrupter held inside an insulation frame;

a fixed electrode-rod mounted on one side of said vacuum interrupter;

a movable electrode-rod mounted on the other side of said vacuum interrupter;

a flexible conductor for electrically connecting said movable electrode-rod with a main-circuit conductor; and a movable-electrode-side connection-terminal fastened on the outer circumference of said movable electrode-rod; wherein said flexible conductor is gripped by a first face and a second face of said movable-electrode-side connection-terminal; and the movable-electrode-side connection-terminal has a slit, where the first face and the second face are formed, into which one end of the flexible conductor is inserted so that said flexible conductor is tightly clamped by the slit between the first face and the second face.

4. A vacuum circuit breaker, comprising:

a vacuum interrupter held inside an insulation frame;

a fixed electrode-rod mounted on one side of said vacuum interrupter;

a movable electrode-rod mounted on the other side of said vacuum interrupter;

a flexible conductor for electrically connecting said movable electrode-rod with a main-circuit conductor; and a movable-electrode-side connection-terminal fastened on the outer circumference of said movable electrode-rod; wherein said flexible conductor is gripped by a first face and a second face of said movable-electrode-side connection-terminal;

the movable-electrode-side connection-terminal comprises a first movable-electrode-side connection-terminal and a second movable-electrode-side connection-terminal, the first movable-electrode-side connection-terminal has the first face, the second movable-electrode-side connection-terminal has the second face that faces the vacuum interrupter, a male screw-thread is made on the external circumference of the movable electrode-rod, a female screw-thread that engages with the male screw-thread is made in each of the first movable-electrode-side connection-terminal and the second movable-electrode-side connection-terminal, and a female screw-thread that engages with the male screw-thread is made in the flexible conductor.

5. The vacuum circuit breaker as set forth in claim 1, wherein the portion of the flexible conductor that is gripped by the first face and the second face of the movable-electrode-side connection-terminal is provided only on one side of the movable electrode-rod.

6. The vacuum circuit breaker as set forth in claim 1, wherein a portion of the movable-electrode-side connection-terminal that grips the flexible conductor includes two bolt holes laterally offset from each other.

7. The vacuum circuit breaker as set forth in claim 1, wherein the movable-electrode-side connection-terminal has a height dimension parallel to an axial direction of the movable electrode-rod when the movable-electrode-side connection-terminal is fastened to the movable electrode-rod, and has a width dimension perpendicular to the height, and the width dimension is greater than the height dimension.

8. The vacuum circuit breaker as set forth in claim 1, wherein the movable electrode-rod is exposed.

9. The vacuum circuit breaker as set forth in claim 1, wherein the movable-electrode-side connection-terminal has a bolt hole extending perpendicular to an axial direction of movable electrode-rod for clamping the movable-electrode-side connection-terminal to the movable electrode-rod.

10. The vacuum circuit breaker as set forth in claim 1, wherein the movable electrode-rod penetrates through the top-most surface and the bottom-most surface of the movable-electrode-side connection-terminal.

* * * * *